US012037860B2

(12) United States Patent
Heichel et al.

(10) Patent No.: US 12,037,860 B2
(45) Date of Patent: Jul. 16, 2024

(54) CONSTRUCTION MACHINE FOR SPECIAL CIVIL ENGINEERING

(71) Applicant: ABI Anlagentechnik-Baumaschinen-Industriebedarf Maschinenfabrik und Vertriebsgesellschaft mbH, Niedernberg (DE)

(72) Inventors: Christian Heichel, Niedernberg (DE); Tobias Schmidt, Aschaffenburg (DE)

(73) Assignee: ABI Anlagentechnik-Baumaschinen-Industriebedarf Maschinenfabrik und Vertriebsgesellschaft mbH, Niedernberg (DE)

( * ) Notice: Subject to any disclaimer, the term of this patent is extended or adjusted under 35 U.S.C. 154(b) by 256 days.

(21) Appl. No.: 17/692,323

(22) Filed: Mar. 11, 2022

(65) Prior Publication Data

US 2022/0341264 A1 Oct. 27, 2022

(30) Foreign Application Priority Data

Apr. 22, 2021 (EP) ..... 21169978

(51) Int. Cl.
*E21B 3/02* (2006.01)
*E02D 7/06* (2006.01)
(Continued)

(52) U.S. Cl.
CPC ..... *E21B 3/022* (2020.05); *E02D 7/22* (2013.01)

(58) Field of Classification Search
CPC ... E21B 3/00; E21B 3/02; E21B 3/022; E21B 19/08–087
See application file for complete search history.

(56) References Cited

U.S. PATENT DOCUMENTS 3,390,730 A * 7/1968 Stenuick ..... E21B 17/1078 175/171
5,269,107 A * 12/1993 Klemm ..... E21B 7/023 52/115
(Continued)

FOREIGN PATENT DOCUMENTS

DE 195 14 288 A1 10/1996
DE 102 06 646 C1 7/2003
(Continued)

OTHER PUBLICATIONS

European Search Report dated Oct. 20, 2021 in European Application No. 21169978.0 with English translation of the relevant parts.

*Primary Examiner* — Frederick L Lagman
*Assistant Examiner* — Stacy N Lawson
(74) *Attorney, Agent, or Firm* — Collard & Roe, P.C.

(57) ABSTRACT

A construction machine for special civil engineering, includes a leader on which an advancing carriage is guided, which carriage has a holder for a work device, in particular a drilling implement or pile-driving implement, and which carriage is connected with a first drive, by way of which it can be moved along the leader. An additional auxiliary carriage is arranged on the leader, which carriage can be moved along the leader by way of a second drive, wherein at least one actuator and/or at least one sensor is/are arranged on the auxiliary carriage.

20 Claims, 9 Drawing Sheets

(51) Int. Cl.

| | |
|---|---|
| ***E21B 7/00*** | (2006.01) |
| ***E21B 12/06*** | (2006.01) |
| *E02D 7/22* | (2006.01) |

(56) References Cited

U.S. PATENT DOCUMENTS

| | | | | |
|---|---|---|---|---|
| 5,431,234 | A * | 7/1995 | Klemm | E21B 7/20 173/184 |
| 5,944,452 | A | 8/1999 | Reinert, Sr. | |
| 6,047,771 | A * | 4/2000 | Røynestad | E21B 19/084 166/380 |
| 8,646,546 | B2 | 2/2014 | Biserna | |
| 9,540,887 | B2 | 1/2017 | Ditillo et al. | |
| 10,344,586 | B2 | 7/2019 | Korherr et al. | |
| 2011/0174511 | A1* | 7/2011 | Biserna | E21B 7/02 173/141 |
| 2015/0176337 | A1* | 6/2015 | Ditillo | E21B 7/005 175/84 |
| 2016/0097177 | A1* | 4/2016 | Lebreton | E02D 5/30 405/232 |
| 2016/0305234 | A1* | 10/2016 | Korherr | E21B 15/003 |
| 2018/0313165 | A1* | 11/2018 | Gillibrand | E21B 7/20 |
| 2020/0149241 | A1* | 5/2020 | Flanigan | E02D 13/00 |
| 2021/0189809 | A1* | 6/2021 | Ditillo | E21B 17/00 |

FOREIGN PATENT DOCUMENTS

| | | |
|---|---|---|
| DE | 10 2007 043 045 A1 | 3/2009 |
| EP | 1 983 149 B1 | 5/2017 |
| RU | 2 717 550 C1 | 3/2020 |

* cited by examiner a)

b)

a)

b)

a)

b)

a)

b)

a)

b)

a)

b)

a)

b)

CONSTRUCTION MACHINE FOR SPECIAL CIVIL ENGINEERING

CROSS REFERENCE TO RELATED APPLICATIONS

Applicant claims priority under 35 U.S.C. § 119 of European Application No. 21169978.0 filed Apr. 22, 2021, the disclosure of which is incorporated by reference.

BACKGROUND OF THE INVENTION

1. Field of the Invention

The invention relates to a construction machine for special civil engineering, having a leader on which an advancing carriage is guided, which carriage has a holder for a work device, in particular a drilling implement or pile-driving implement.

2. Description of the Related Art

Construction machines of the type stated above serve, in particular, to hold a drilling implement or a pile-driving implement. In the case of Kelly drilling, the work is usually carried out using a drilling implement that is held by the advancing carriage, in such a manner that first the drill pipe and the drilling screw are connected with the drilling drive and brought into position. The drill pipe is sunk with an advance. The amount of the advance depends, in this regard, on the corresponding ground consistency. In the case of heavy soils, this advance is minimal, because resistances are reduced by means of freeing the drill pipe from drilled material.

The auger is attached at the end of a Kelly drill rod set, also called a Kelly rod. The Kelly rod consists of multiple drill rods inserted into one another, which are provided with drive strips for transfer of torque.

The auger is screwed into the ground within the pipe, wherein its flute fills with drilled material during this process. When the auger is filled with drilled material, it is pulled out of the drill pipe and the drilled material is spun off. For this purpose the auger is repeatedly accelerated and then stopped. Once the first pipe section has been sunk, a further pipe piece is coupled with the Kelly rod. In order to reach the required drilling depth, the Kelly rod is telescoped. This procedure is repeated until the desired drilling depth has been reached. In this manner, boreholes can be achieved that are many times deeper than the length of the leader. Kelly drilling is characterized by different discontinuous work steps. Thus, for example, a pipe section has to be picked up manually, again and again, or two pipes must be set one on the other. These work steps require experienced operators who can routinely position pipes having a length of several meters, using a machine that has a working weight between 40 metric tons and 120 metric tons, with a tolerance in the millimeter range. These process steps are therefore connected with a high level of cognitive effort, and this effort leads to rapid tiring of the operator. Support of the operator by means of assistance systems proves to be difficult, because a related sensor system with different working positions on the leader, relative to the advancing carriage, is necessary. For example, the position of a drill pipe that is in the ground and onto which a further drill pipe is supposed to be placed must be detected at a height between approximately 0.5 m and 2 m above the ground. In order to pick up a drill pipe having a length of 6 m, for example, which has been set down, from its set-down position, the position below the upper edge of the piece of pipe must be detected, if at all possible, so as to allow equalization of angle deviations.

A pile-driving implement held by the holder of the advancing carriage of the construction machine also requires the same great cognitive effort of the operator. Thus, for example, when setting up a sheet pile wall, corresponding sheet pile sections having a length of several meters must be picked up by the pile-driving implement, so as to introduce these sections into the soil in a defined manner. Here, too, support to the operator by means of assistance systems is difficult to accomplish.

SUMMARY OF THE INVENTION

Against this background, the invention seeks to provide a remedy. The invention is based on the task of making available a construction machine for special civil engineering, for holding a drilling implement or pile-driving implement, which machine allows simplified operation. These and other tasks are accomplished by means of a construction machine having the characteristics according to the invention.

With the invention, a construction machine for special civil engineering, for holding a drilling implement or pile-driving implement, is made available, which machine allows simplified operation. Because an auxiliary carriage is arranged on the leader, which carriage can be moved along the leader by way of a second drive, wherein at least one actuator and/or one sensor is/are arranged on the auxiliary carriage, sensing or actuating support of the operator is made available. In this regard, the auxiliary carriage is preferably guided on the leader.

In the present case, an auxiliary carriage is understood to be a carriage that can be moved along the leader, does not contribute directly to the drilling or pile-driving process, and, in particular, does not apply an advancing force to a work device. The auxiliary carriage thereby distinguishes itself from the advancing carriage, which holds a work device and applies an advancing force to it during the work process.

In the present case, an actuator is understood to be a component that performs a defined movement, when a signal is applied, relative to the auxiliary carriage on which the component is arranged. The signal can be an electrical, a hydraulic, a pneumatic or a mechanical signal. The defined movement can be, for example, extension or positioning of an arm.

In a further development of the invention, the auxiliary carriage can be moved relative to the advancing carriage. In this way, positioning of the auxiliary carriage with the at least one actuator and/or sensor arranged on it, relative to the work device, is made possible. In this regard, the auxiliary carriage can preferably be moved independent of the advancing carriage.

In an embodiment of the invention, the second drive is connected with a cable winch that can be driven by way of the second drive, the cable of which winch is connected with the auxiliary carriage.

In a further development of the invention, the auxiliary carriage is provided with at least one winch, preferably two winches, the cables of which are connected with the advancing carriage, whereby positioning of the auxiliary carriage takes place independently of the advancing carriage.

In a further embodiment of the invention, the second drive is formed by an electric motor. In this way, a drive that is both very easy to regulate and also advantageous is provided, which drive allows precise positioning of the auxiliary carriage. Furthermore, simple connection of the auxiliary carriage with the construction machine is made possible, because no hydraulic lines and supply valves need to be provided. Preferably, the second drive and the cable winch are arranged on the advancing carriage.

In a further development of the invention, at least one image-producing sensor and/or at least one distance sensor is/are arranged on the auxiliary carriage. In this way, continuous detection of the position of a tool or of a material to be pile-driven, in particular of a pipe or also of a sheet pile, is achieved.

In a further embodiment of the invention, two distance sensors are provided, which are set at a defined angle relative to the auxiliary carriage and form a first sensor system unit. Preferably, a second sensory system unit is arranged on the auxiliary carriage at a distance from the first sensor system unit, which unit in turn is formed by two distance sensors that are set at a defined angle relative to the auxiliary carriage. In this way, both the position of a pipe being held or of a sheet pile being held and its axial position can be detected. It is advantageous if at least one of the distance sensors is an ultrasound sensor and/or one of the distance sensors is a light detection and ranging (LIDAR) sensor.

In a further embodiment of the invention, at least one sensor is connected with the machine controller and/or the operating terminal of the construction machine. In this way, use of the detected relative position of a pipe being held or of a sheet pile section being held, for assisted or automatic corrections of the position, by the operator or also by the machine controller, is made possible. For example, the output signals of the at least one sensor can be applied to a position regulator that controls both the kinematics by way of which the leader is connected with the carrier device and also with the advancing carriage, so as to bring about movement of a pipe parallel to the ground.

It is advantageous if an image-producing sensor arranged on the auxiliary carriage is connected with a monitor. In this way, visual detection, by the operator, of the relative position of a pipe being held or of a sheet pile section being held is made possible.

In a further development of the invention, the auxiliary carriage has at least one actuator that comprises a pivoting and/or extendable arm, which can be controlled by way of a control unit arranged on the construction machine. In this way, manipulation of the object held by the work device is made possible. In this regard, the control unit provided can be connected, for example, with an operating lever that can be activated by the operator. Automatic control of the arm by means of the controller is also possible; for this purpose, the controller is preferably connected with the sensors arranged on the auxiliary carriage. The pivoting and/or extendable arm can be connected with a drive, in particular an electric motor, which is connected with the controller and by way of which the arm can be moved.

In an embodiment of the invention, a manipulator, in particular a gripper and/or a screwing tool and/or a drilling flute cleaning tool is arranged on the arm of at least one actuator. In this way, defined manipulation of the object held by the work device is made possible.

In a further embodiment of the invention, the arm is connected with a hydraulically or electrically driven swivel motor or cylinder, by way of which it can be pivoted. Preferably, the swivel motor or the cylinder has a self-locking mechanism. In this way, a stable position of the arm in a pivoted position is guaranteed.

In a further embodiment of the invention, a read device and/or a write device for contact-free data collection and/or data storage is/are provided on the auxiliary carriage. In this way, detection of data affixed to the object to be picked up by the work device, for example in the form of a barcode, a radio frequency identification (RFID) chip or some other identification that can be read in contact-free manner is achieved. By way of a write device, times of operation, for example, can be stored in memory on an RFID chip that is provided. In this way the work device and pipes can be recorded and provided with a work history.

In a further embodiment of the invention, the construction machine comprises a control device that is connected with the drive of the advancing carriage and the drive of the auxiliary carriage, and comprises a memory module in which at least one movement sequence of the auxiliary carriage and its actuators is stored in memory. In this way an automated process sequence, for example for cleaning of an auger, is made possible.

In a further development of the invention, the control device is connected with at least one sensor of the auxiliary carriage and set up in such a manner that a movement of the auxiliary carriage and/or of at least one actuator takes place as a function of the sensor signals detected. For this purpose, algorithms can be stored in the control device, which initiate a movement of the auxiliary carriage or an outward movement of the drilling flute cleaning tool as a function of the positions of the auger or of a pipe, as detected by the sensors, a target position, for example the start of the drilling flute, or a connection position with a drill pipe to be picked up.

BRIEF DESCRIPTION OF THE DRAWINGS

Other objects and features of the invention will become apparent from the following detailed description considered in connection with the accompanying drawings. It is to be understood, however, that the drawings are designed as an illustration only and not as a definition of the limits of the invention.

In the drawings.

DETAILED DESCRIPTION OF PREFERRED EMBODIMENTS

Figure 1:
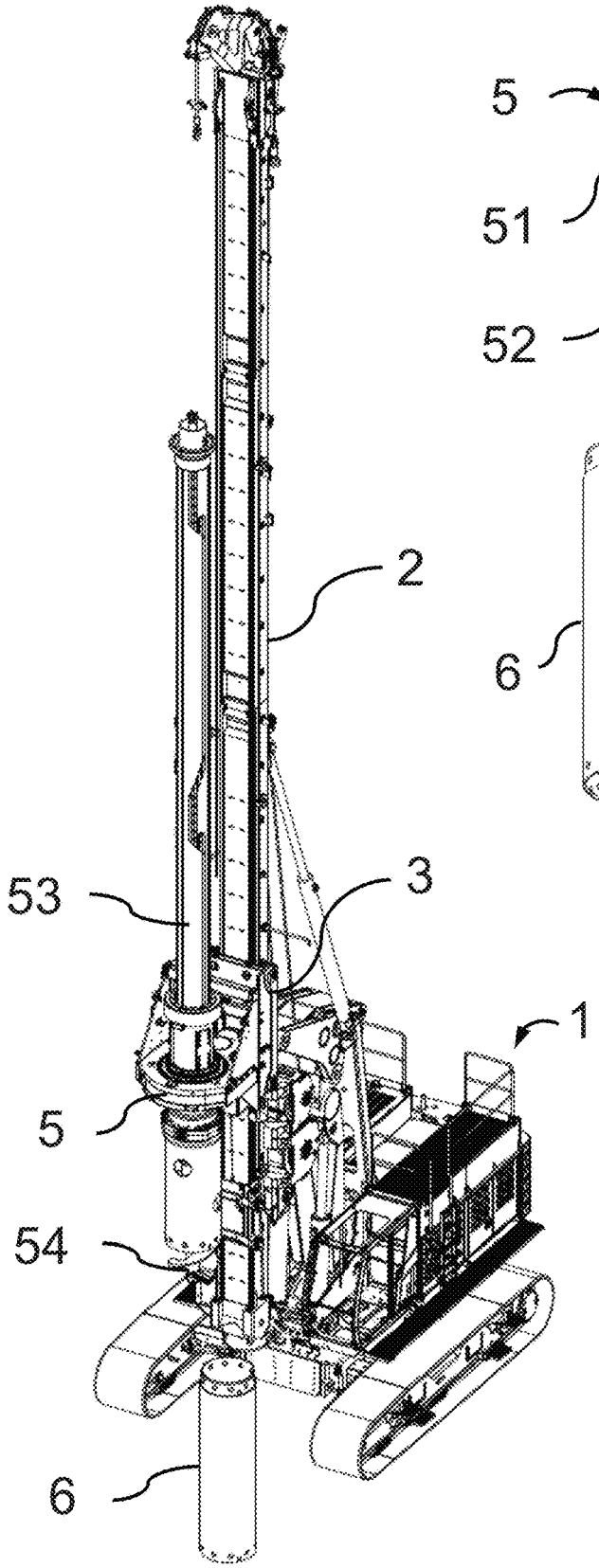
FIG. 1A is a side view of a construction machine having a drilling implement with a pressure pipe, arranged on a leader, before picking up a drill pipe (the pressure pipe lies outside of the borehole axis)
FIG. 1B is a detail representation of a cut-out of the representation of the construction machine from FIG. 1A with the advancing carriage and auxiliary carriage.
Figure 1:
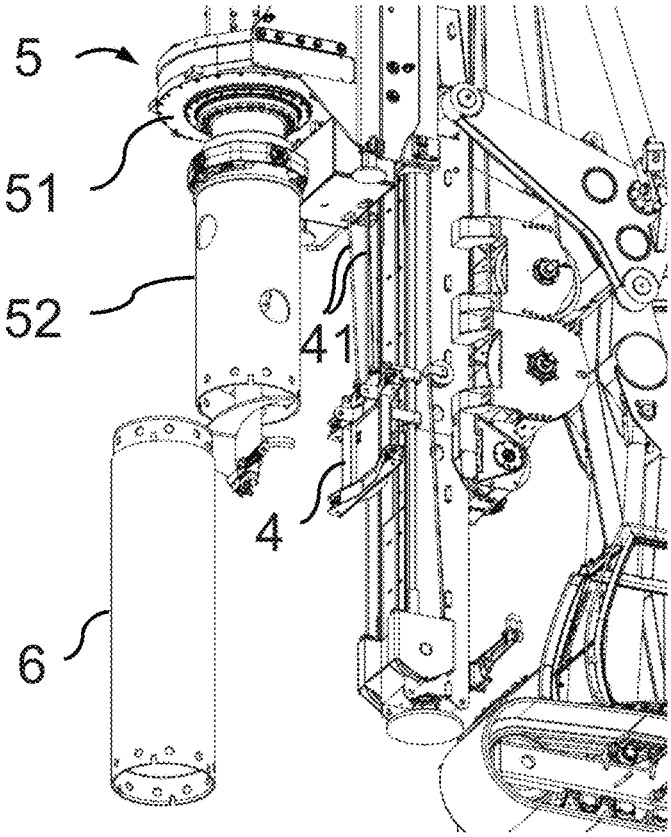
Figure 2:
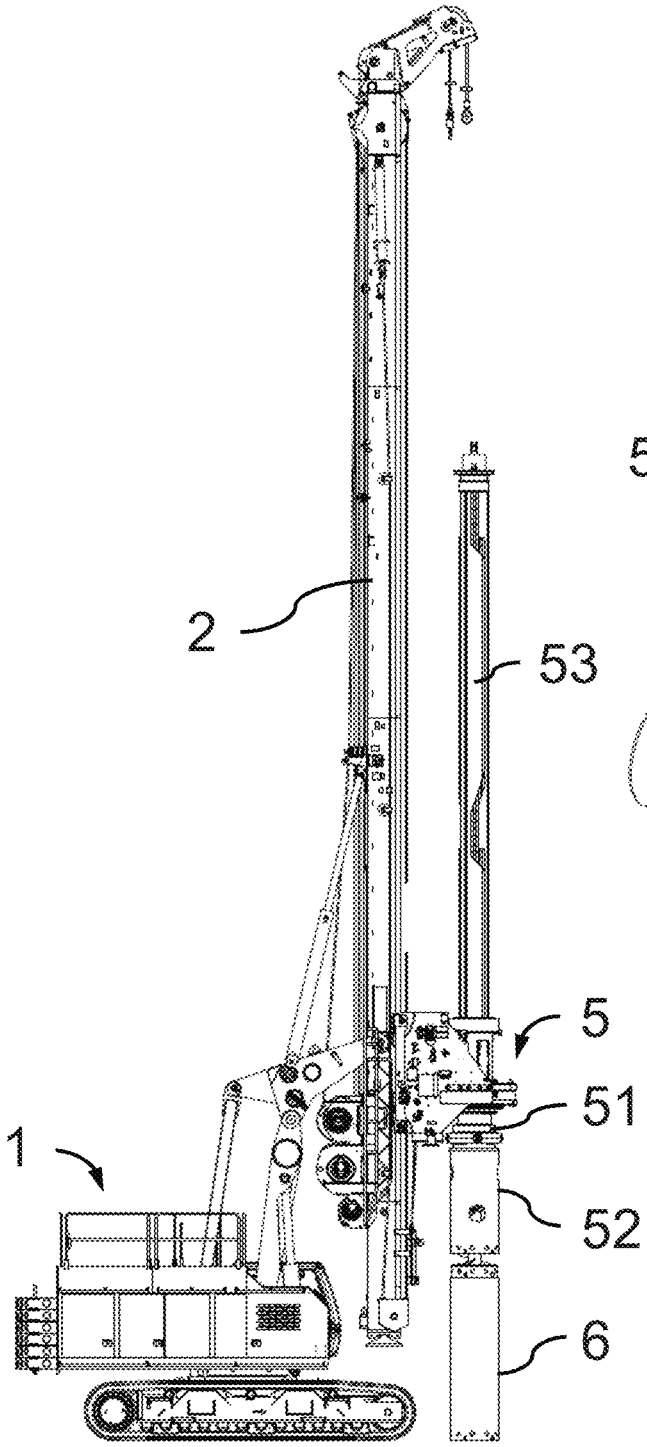
FIG. 2A is a spatial representation of the construction machine from FIG. 1A with a pressure pipe pre-positioned in the borehole axis.
FIG. 2B is a detail representation of a cut-out of the representation of the construction machine from FIG. 2A with the advancing carriage and auxiliary carriage.
Figure 2:
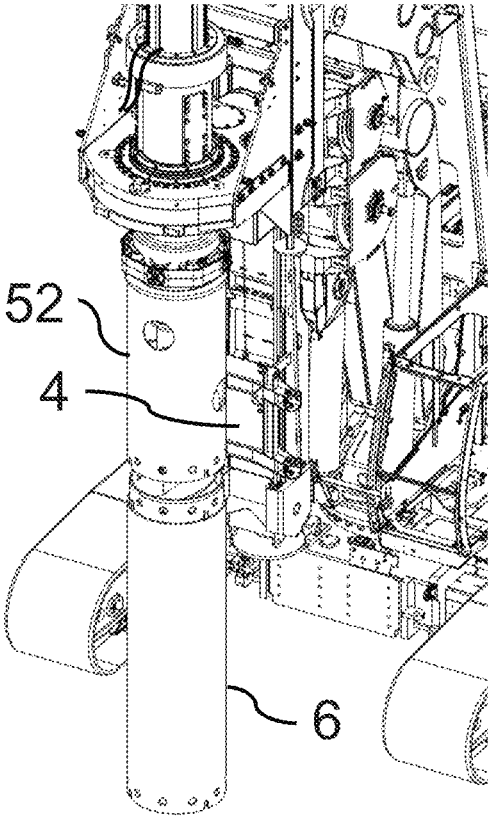
Figure 3:
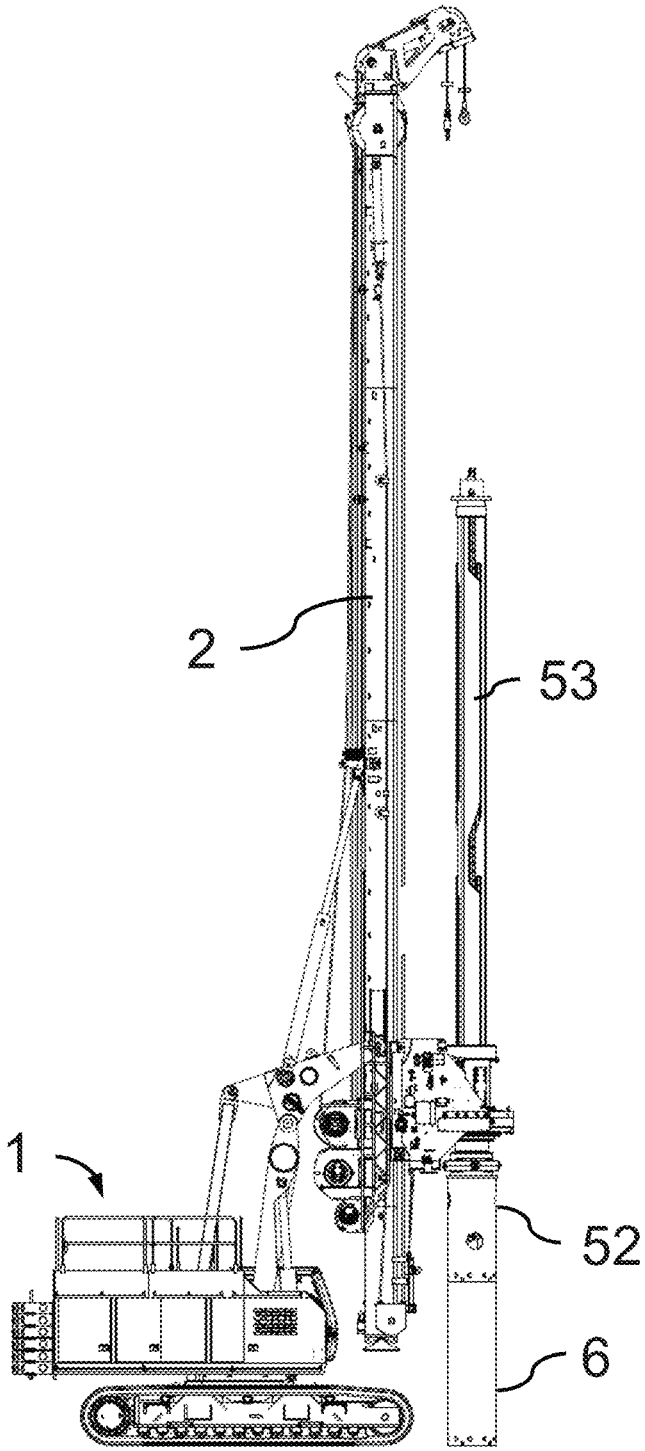
FIG. 3A is a side view of the construction machine from FIG. 1A with the drill pipe picked up.
FIG. 3B is a detail representation of a cut-out of the representation of the construction machine from FIG. 3A with the advancing carriage and auxiliary carriage.
Figure 3:
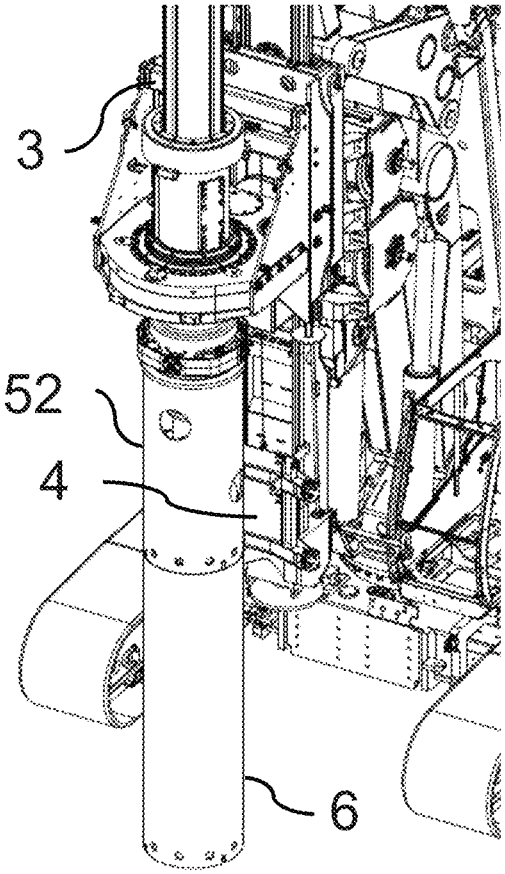
Figure 4:
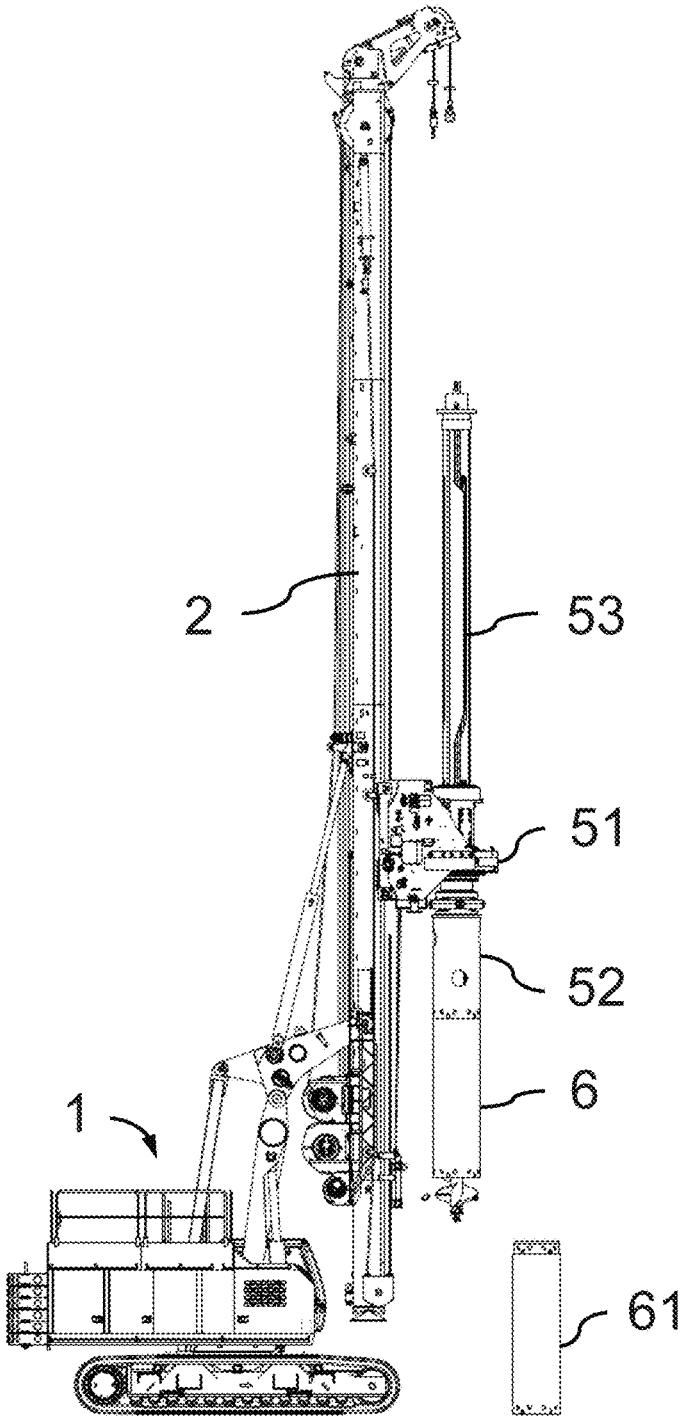
FIG. 4A shows a side view of a construction machine having a drilling implement with a mounted first drill pipe, arranged on a leader, before picking up a further drill pipe (the pressure pipe with the mounted first drill pipe lies outside of the drilling axis)
FIG. 4B is a detail representation of a cut-out with the advancing carriage and auxiliary carriage of the construction machine having a drilling implement with a mounted first drill pipe, arranged on a leader, before picking up a further drill pipe (the pressure pipe with the mounted first drill pipe lies outside of the drilling axis)
Figure 4:
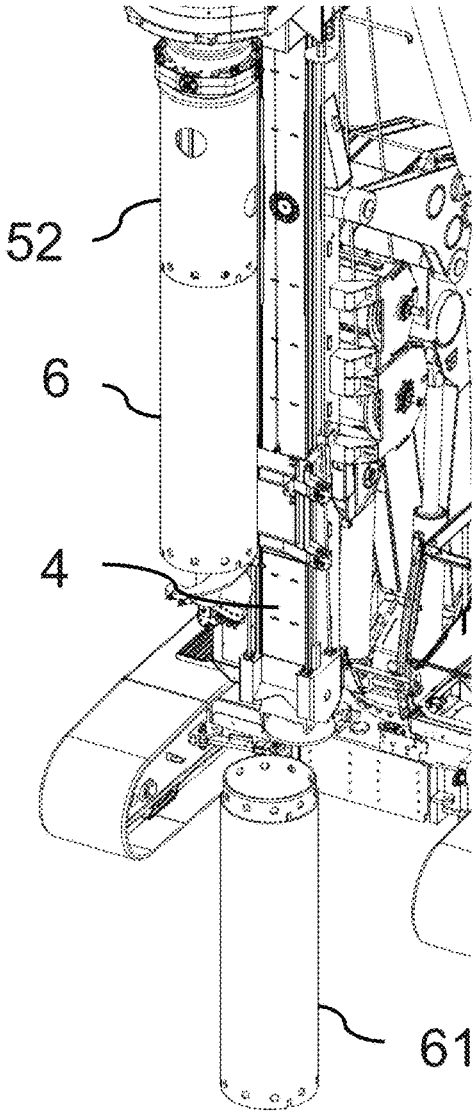
Figure 5:
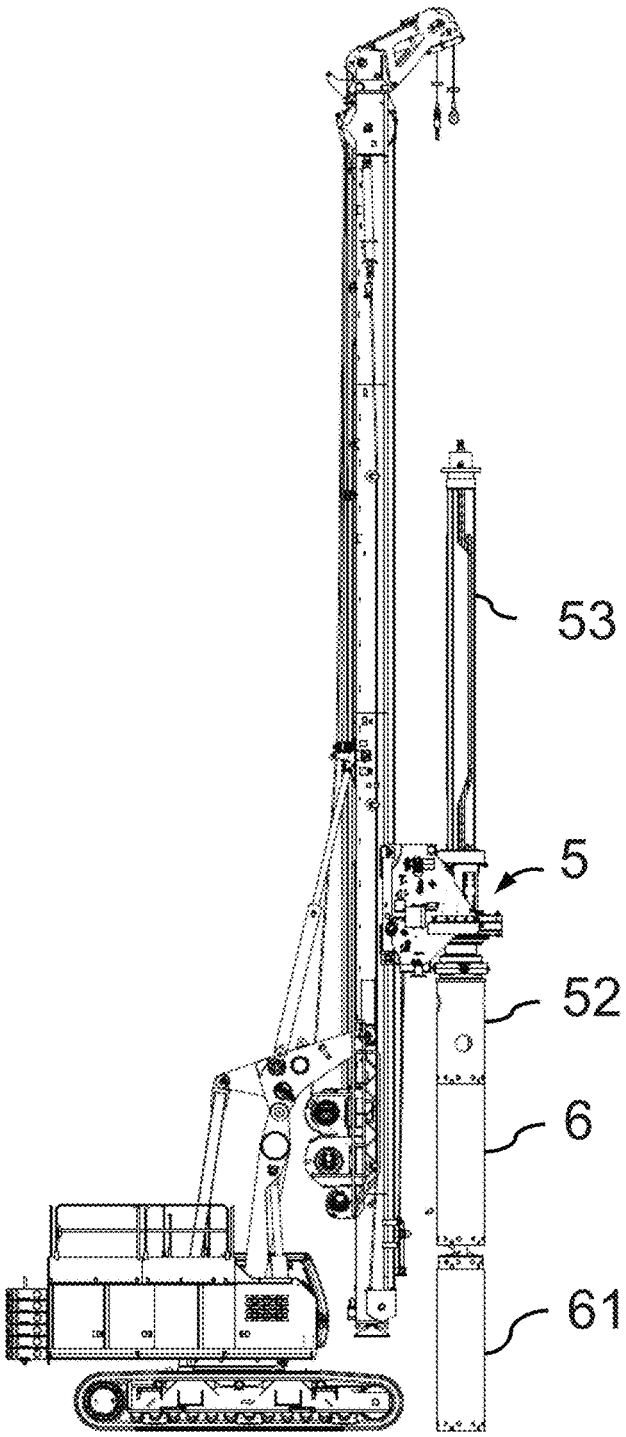
FIG. 5A is a side view of the construction machine from FIG. 4A with the pre-positioned first drill pipe (pressure pipe in the borehole axis)
FIG. 5B is a detail representation of a cut-out of the representation of the construction machine from FIG. 4A with the advancing carriage and auxiliary carriage.
Figure 5:
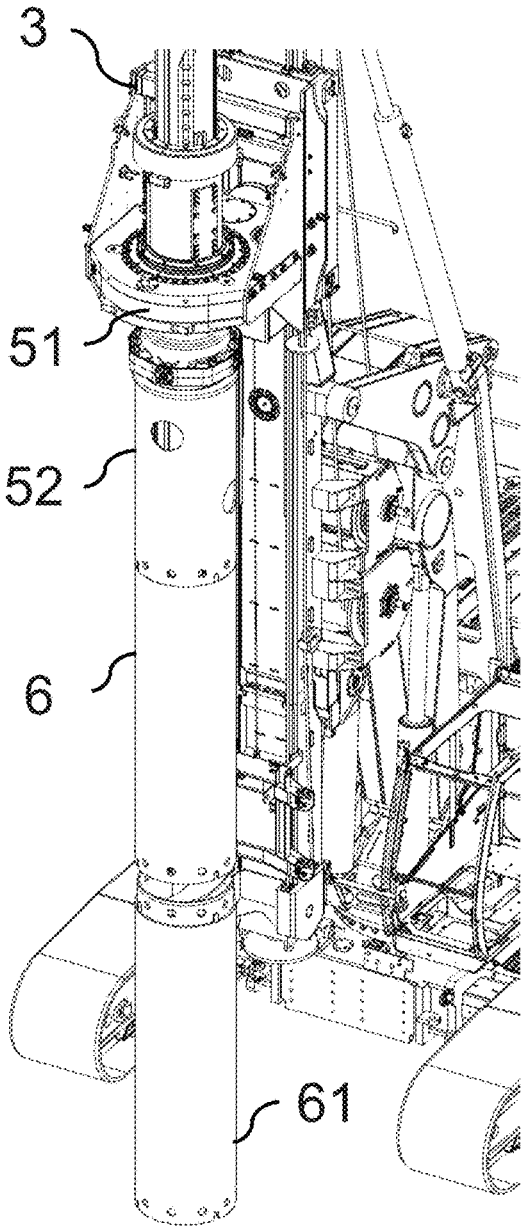
Figure 6:
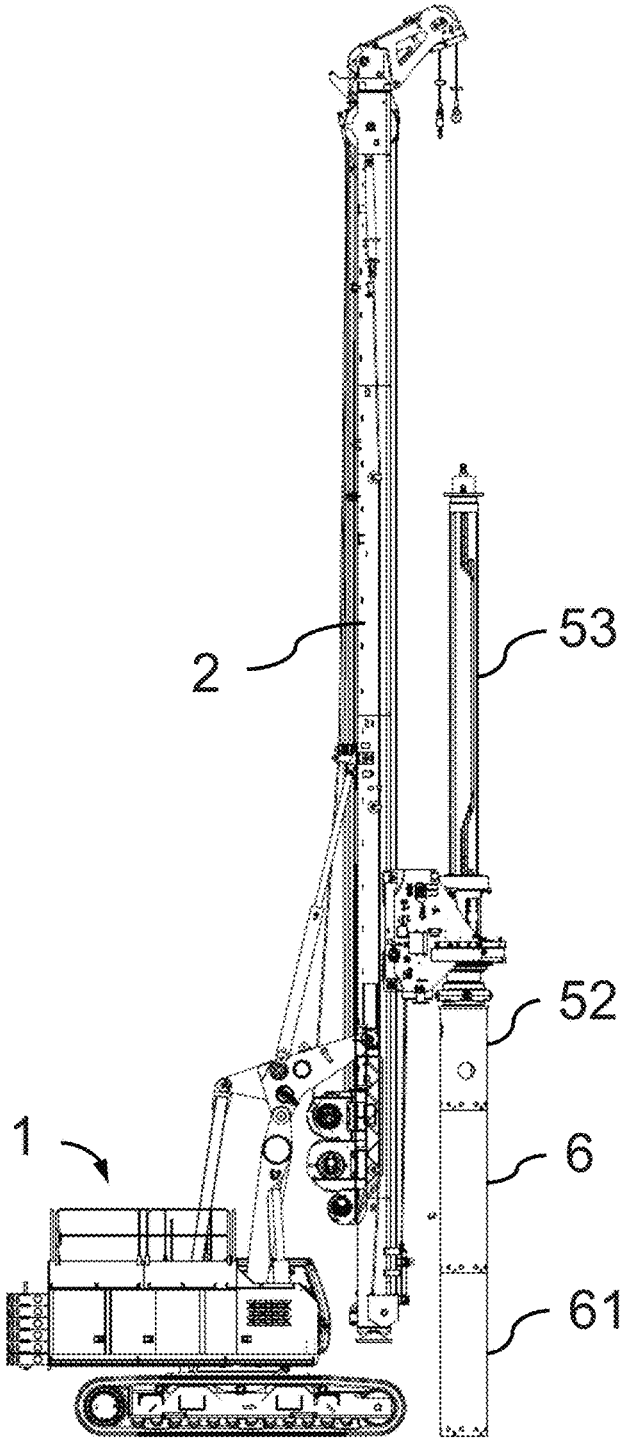
FIG. 6A is a side view of the construction machine from FIG. 4A with the second drill pipe picked up.
FIG. 6B is a detail representation of a cut-out of the representation of the construction machine from FIG. 4A with the advancing carriage and auxiliary carriage.
Figure 6:
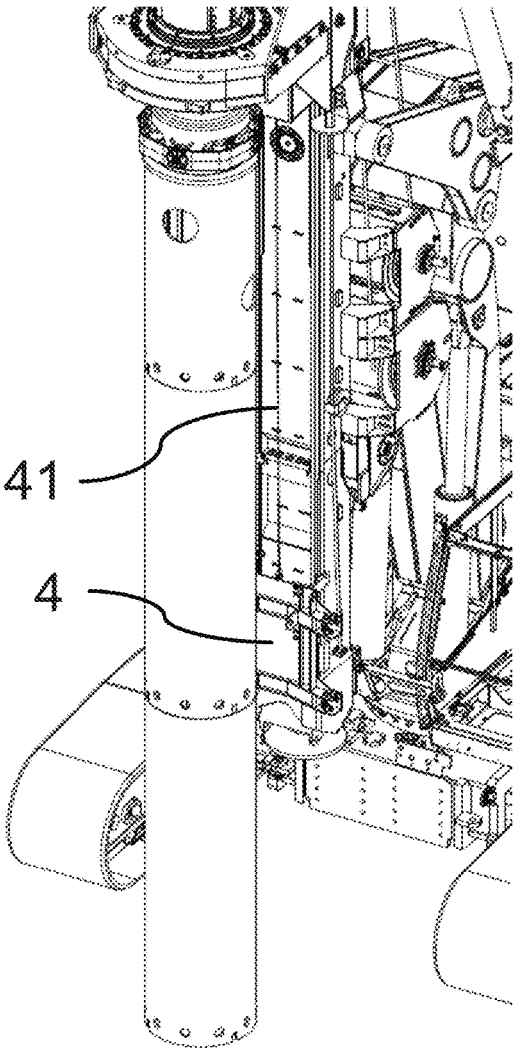

The construction machine selected as an exemplary embodiment is structured as a drilling rig and essentially consists of a carrier device 1 that is connected, in a known manner, with a leader 2, by way of kinematics, on which leader an advancing carriage 3 is displaceably arranged, on which carriage a drilling implement 5 is attached. The fundamental structure of such a drilling rig is generally known and is also described in DE 195 14 288 A1, for example. The drilling implement 5 comprises a drilling drive 51, which is attached to the advancing carriage 3 and has a pressure pipe 52. The drilling drive 51 holds a Kelly rod 53 that projects through the pressure pipe 52 and can be rotated by way of the drilling drive 51. On the end side, an auger 54 is attached to the Kelly rod 53.

Figure 7:
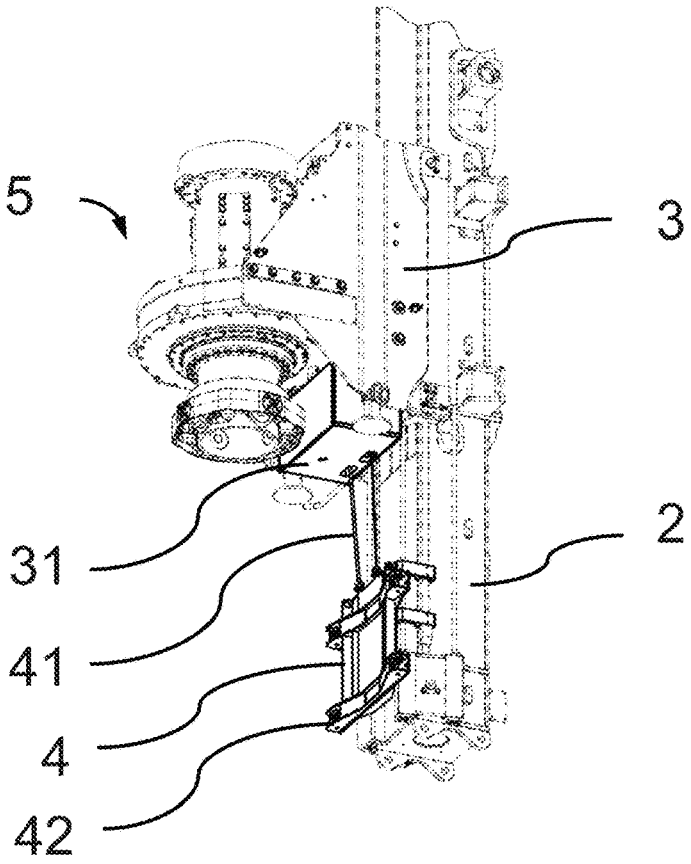
FIG. 7 is a schematic representation of the leader of a construction machine, with a drilling implement and auxiliary carriage arranged on the advancing carriage.
Figure 8:
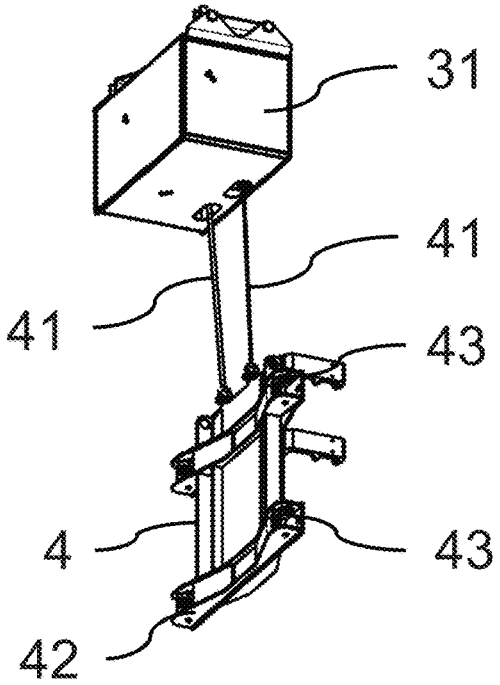
FIG. 8 is a schematic representation of the auxiliary carried with drive unit from FIG. 7.

An auxiliary carriage 4 is guided on the leader 2 at a distance from the advancing carriage 3. Two cables 41 are attached to the auxiliary carriage 4, which cables are taken up by a cable winch—not shown—that is connected with an electric motor—not shown—by way of which the cable winch can be driven. In the exemplary embodiment, the cable winch and the electric motor are arranged in a drive housing 31, which is attached to the advancing carriage 3 (see FIGS. 7 and 8). By winding up or unwinding the cables 41, a movement of the auxiliary carriage 4, which is guided on the leader 2, is thereby brought about, independent of and relative to the advancing carriage 3. The electric motor is supplied with electricity by a rechargeable battery, which is also arranged in the drive housing 31 in the exemplary embodiment.

By means of the use of the electric motor, which can be regulated very well and is comparatively inexpensive, precise positioning of the auxiliary carriage 4 is made possible. Furthermore, easy connection of the auxiliary carriage 4 to the construction machine is made possible, because no hydraulic lines and supply valves need to be provided.

On the auxiliary carriage 4, two sensor units 42 are arranged at a distance from one another in the longitudinal direction of the leader 2. Each unit comprises two distance sensors 43 arranged at a distance from one another in the transverse direction of the auxiliary carriage 4, whereby four distance sensors 43 are provided, which are positioned at the corners of an imaginary rectangle. In the exemplary embodiment, the distance sensors 43 are configured as ultrasound sensors. Alternatively, other distance sensors, preferably contact-free ones, can be provided, such as, for example, optical, inductive or capacitive sensors. Distance sensors that make contact, such as sensor levers or measuring pins, can also be used. In the exemplary embodiment, four of the same type of distance sensors 43 are provided. Different sensors can also be provided, wherein preferably the same type of sensors are used in pairs. It is advantageous if a sensor unit 42 is equipped with the same sensors in each instance. A sensor unit can also have three or more sensors. In this regard, not all the sensor units have to have the same number of sensors. Both distance sensors and image-producing sensors can be provided.

The distance sensors 43 are connected with a computer unit—not shown—that is arranged in the drive housing 31, by way of electrical lines; electricity is provided to the computer unit by way of the rechargeable battery. The lines serve both for providing electricity to the distance sensors 43 and for transmitting the signals of the distance sensors 43 to the computer unit. In the exemplary embodiment, the lines are integrated into the cables 41. The computer unit has a wireless transmission and reception unit, by way of which it is connected with a control device arranged in the carrier device. If an image-producing sensor is provided, the computer unit is also connected with a monitor, by way of the wireless transmission and reception unit, by way of which monitor graphic representation of the transmitted image signals takes place.

By way of the computer unit—not shown—that is arranged in the drive housing 31, control of the electric motor with which this unit is connected is furthermore also possible. Control of the electric motor can take place by means of the control unit arranged in the carrier device 1, by way of wireless initiation of the computer unit. Alternatively, the electric motor can also be connected directly—wirelessly or also by way of lines—with the controller of the carrier device 1 or a separate control device. Furthermore, it is also possible to transmit the signals of the distance sensors 43, wirelessly or by way of lines, directly to a computer unit arranged in the carrier device 1. Consequently, placement of a computer unit in the drive housing 31 is not absolutely necessary. Placement of the cable winch and/or of the electric motor in a drive housing is also not absolutely necessary. These items can also be attached directly to the advancing carriage. It is also possible to place the cable winch on the auxiliary carriage 4, wherein the cable 41 that is taken up by the cable winch is attached to the advancing carriage 3.

In FIGS. 1A to 3B, the construction machine, structured as a drilling rig, is shown in three states when picking up a drill pipe 6 to be connected with the pressure pipe 52 of the drilling drive 51. In FIG. 1A, the drill pipe 6 is inserted into the borehole; the pressure pipe 52 of the drilling drive 51 is situated outside of the borehole axis. As shown in the detail view in FIG. 1B, the auxiliary carriage 4, with the sensor units 42 arranged on it, is positioned at the height of the connection location on the end side of the pressure pipe 52. The distance from the pressure pipe 52, as detected by the distance sensors 43 of the upper sensor unit 42, is significantly less here than the distance from the drill pipe 6 detected by the distance sensors 43 of the lower sensor unit 42. The horizontal offset of the pressure pipe 52 from the drill pipe 6 is also detected by the distance sensors 43. In the exemplary embodiment, the signals of the distance sensors 43 are passed on to the controller in the carrier device 1 by way of the computer unit. Using the continuously delivered sensor signals, the controller performs a calculation of the required movement sequences for positioning the pressure pipe 52 on the drill pipe 6.

In FIG. 2A, the leader 2, with the drilling drive 51 attached to the advancing carriage 3, is positioned in such a manner that the pressure pipe 52 is situated in the borehole axis. In this regard, the pressure pipe 52 was brought close to the drill pipe 6. As shown in the detail view in FIG. 2B, the auxiliary carriage 4, with the sensor units 42 arranged on it, is once again positioned at the height of the connection location. The distance from the pressure pipe 52, as detected by the distance sensors 43 of the upper sensor unit 42, now corresponds to the distance from the drill pipe 6 as detected by the distance sensors 43 of the lower sensor unit 42. In this position, the pressure pipe 52 can be positioned on the drill pipe 6 by means of displacement of the advancing carriage 3 along the leader 2, as shown in FIGS. 3A and 3B. This process can be visually monitored by the operator by way of an optionally additionally provided image-providing sensor, such as a camera, for example, which is connected with a monitor arranged in the cabin of the carrier device 1.

After positioning of the pressure pipe 52 on the drill pipe 6, the bolts required for connection can now be introduced. For this purpose, an actuator in the form of a positioning arm or a gripper can be arranged on the auxiliary carriage 4, by way of which actuator the bolts can be introduced—or removed during the course of disassembly. Activation of this actuator can take place either with remote control by the operator, from the cabin of the carrier device 1, or also in an automated manner, by way of a control device set up for this purpose. For visual monitoring of the actuator movements, an image sensor, in particular in the form of a camera, can be arranged on the auxiliary carriage 4, which sensor is connected with a monitor arranged in the cabin of the carrier device 1.

In FIGS. 4A to 6B, picking up a second drill pipe 61 is shown in an analogous manner, which drill pipe is held by the first drill pipe 6. In this regard, the auxiliary carriage 4, with the sensor units 42 arranged on it, is moved along the leader, relative to the advancing carriage 3, so far until it is positioned at the height of the connection location on the end side of the first drill pipe 6 attached to the pressure pipe 52.

Figure 9:
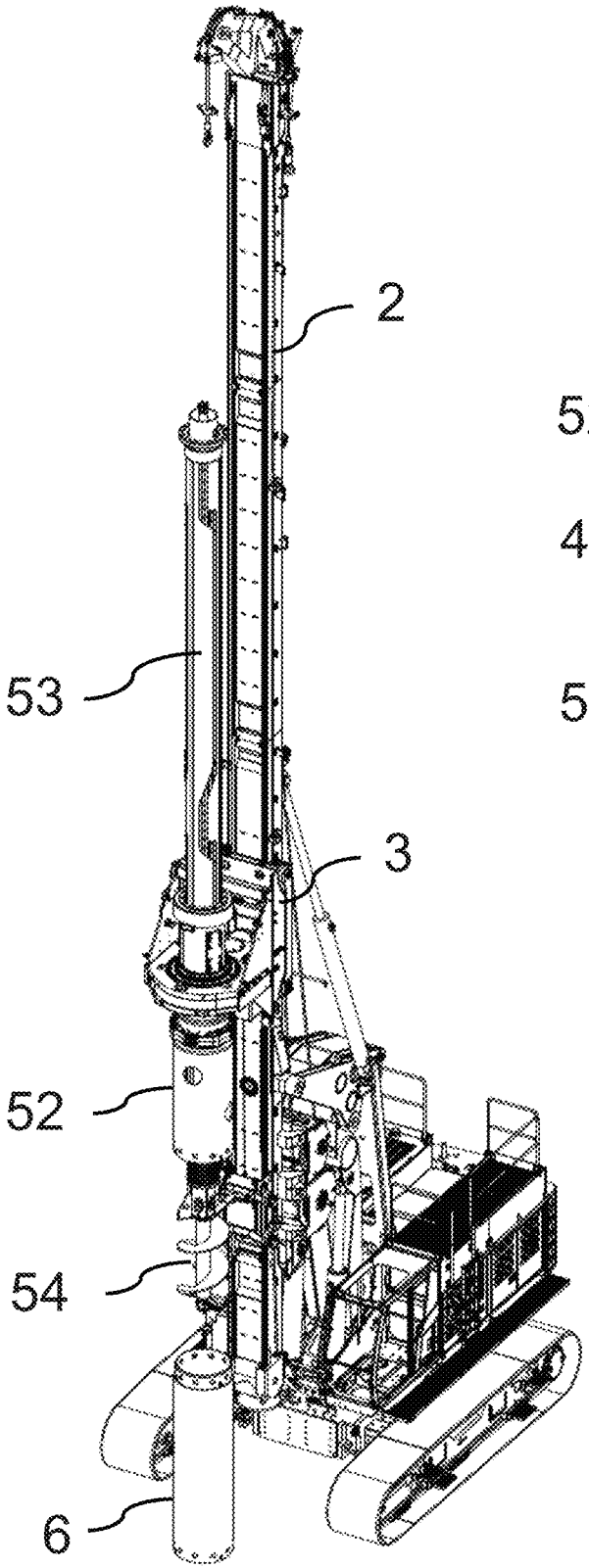
FIG. 9A is a spatial representation of the construction machine having a drilling implement arranged on the leader, with an auger cleaning device in the starting cleaning position.
FIG. 9B is a detail representation of a cut-out with the advancing carriage and auxiliary carriage of the construction machine having a drilling implement arranged on the leader, with an auger cleaning device in the starting cleaning position.
Figure 9:
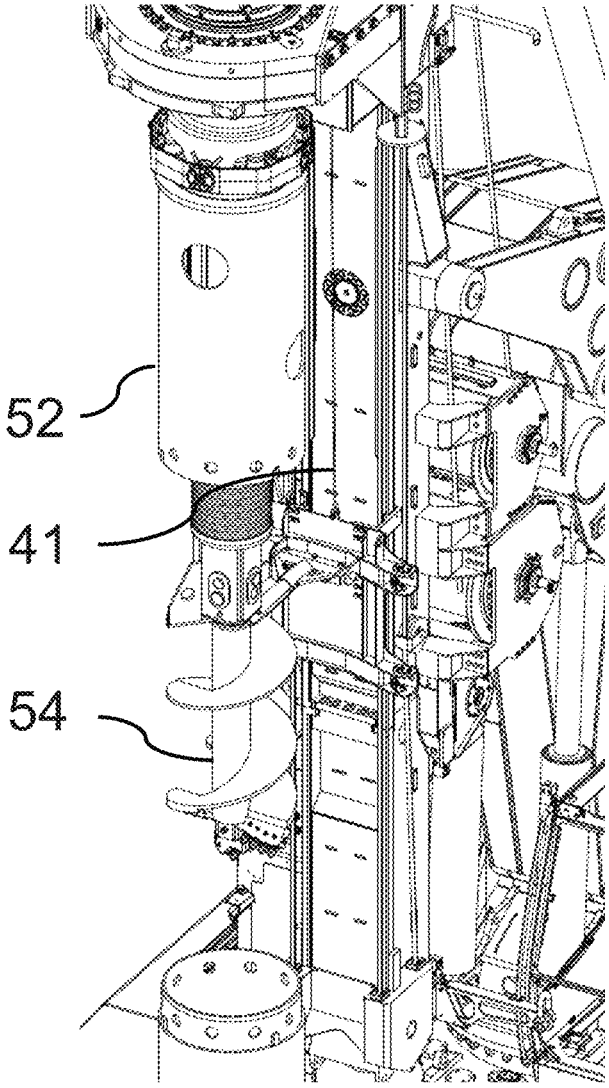

In the exemplary embodiment according to FIGS. 9A and 9B, an actuator in the form of a drilling flute cleaning tool is arranged on the auxiliary carriage. The drilling flute cleaning tool comprises a cylindrically configured cleaning arm 71 to which a scraping bracket 72 is attached, and which is held by a quiver 73 of a holding apparatus 74, which is mounted on the auxiliary carriage 4 so as to pivot by way of an axle 75. The cleaning arm 71 does not necessarily have to be configured cylindrically—it can also be configured in block shape or some other suitable manner. Furthermore, the cleaning arm does not necessarily have to be held by a quiver. It can also be attached directly to the holding apparatus 74.

The pivot axle of the cleaning arm 71 is directed transverse to the displacement direction of the auxiliary carriage 4. The holding apparatus 74 is connected with a pivot drive by way of which it can be pivoted about the axle 75. In the exemplary embodiment, the pivot drive is formed by a hydraulically driven coarse-pitch thread swivel motor. Alternatively, an electric motor can also be provided. In order to achieve a good cleaning effect, the swivel drive should have a self-locking mechanism. This mechanism can be implemented by means of a load-holding valve in the case of a hydraulic swivel motor—in the present case, for example, a coarse-pitch thread swivel motor.

Figure 10:
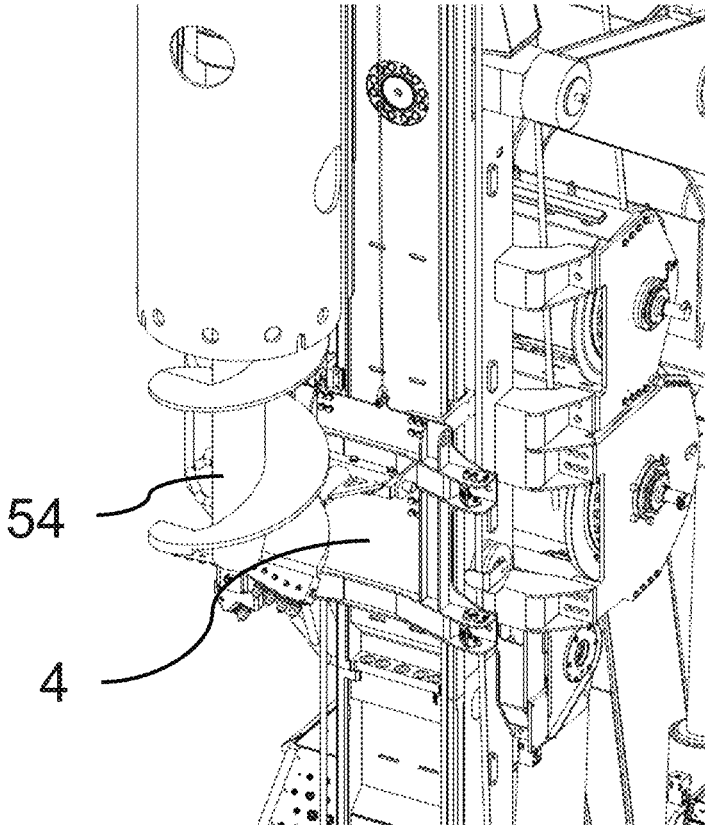
FIG. 10 is a detail representation of the auger from FIG. 9A, with the auger cleaning tool in the ending cleaning position.
Figure 11:
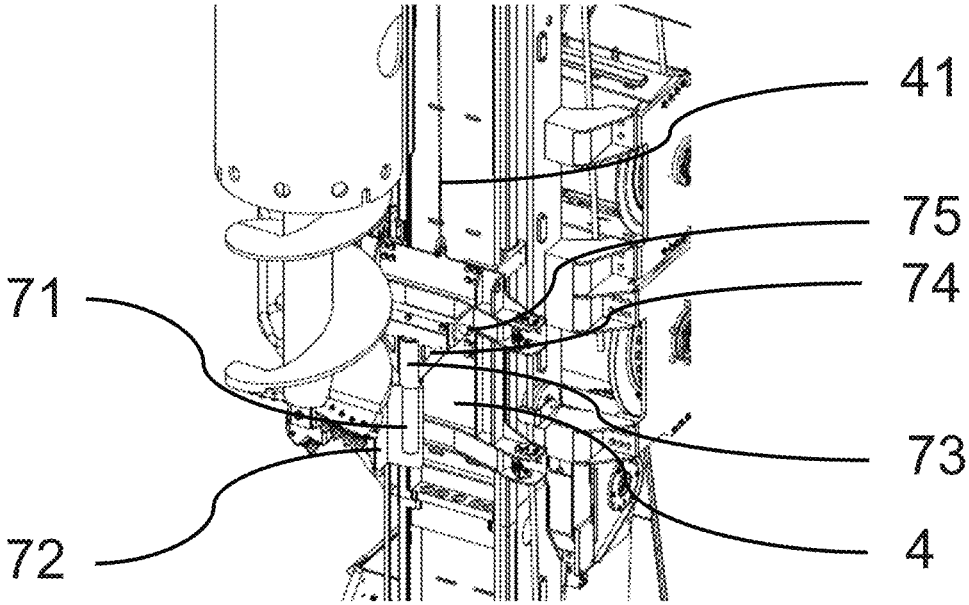
FIG. 11 is a detail representation of the auger from FIG. 9A, with the auger cleaning tool in the folded-away position.

In FIG. 9B, the cleaning arm 71 is pivoted approximately orthogonal to the auxiliary carriage 4 and, in this position, is shown in engagement with the drilling spiral of the auger 54. In this regard, the cleaning arm 71 lies against the upper end of the drilling spiral with the scraping bracket 72. By means of rotation of the auger 54 with simultaneous pulling of the Kelly rod, the scraping bracket 72 slides along the drilling spiral, and thereby soil material adhering to it is removed from the auger 54. In the representation according to FIG. 10, the cleaning arm 71 has passed through the drilling spiral completely, and the auger has been pulled out of the drill pipe 6 up to above the cleaning arm 71. Subsequently the cleaning arm 71 is pivoted out of the working position into the rest position, as shown in FIG. 11. In this position, the cleaning arm 71 has been pivoted downward and is positioned parallel to the guide carriage 4.

Although only a few embodiments of the present invention have been shown and described, it is to be understood that many changes and modifications may be made thereunto without departing from the spirit and scope of the invention.

What is claimed is:

1. A construction machine for special civil engineering, the construction machine comprising:

(a) a leader;

(b) an advancing carriage guided on the leader, the advancing carriage having a holder for a work device performing a drilling or pile-driving process;

(c) a first drive connected with the advancing carriage and configured to move the advancing carriage along the leader;

(d) an auxiliary carriage arranged on a same side of the leader as the advancing carriage;

(e) a second drive configured to move the auxiliary carriage along the leader; and (f) at least one actuator, at least one sensor, or at least one actuator and at least one sensor arranged on the auxiliary carriage, wherein the auxiliary carriage is configured so as not to contribute directly to the drilling or pile-driving process and so as not to apply an advancing force to the work device.

2. The construction machine according to claim 1, wherein the auxiliary carriage is movable relative to the advancing carriage by way of the second drive.

3. The construction machine according to claim 1, wherein the auxiliary carriage is movable independent of the advancing carriage by way of the second drive.

4. The construction machine according to claim 1, wherein the second drive is formed by an electric motor.

5. The construction machine according to claim 4,
wherein the second drive is connected with a cable winch drivable by way of the second drive; and
wherein the cable winch has a cable connected with the auxiliary carriage.

6. The construction machine according to claim 5, wherein the second drive and the cable winch are arranged on the advancing carriage.

7. The construction machine according to claim 1, wherein the at least one sensor arranged on the auxiliary carriage is selected from the group consisting of an image-producing sensor and a distance sensor.

8. The construction machine according to claim 7, wherein the distance sensor comprises first and second distance sensors, which are set at a defined angle relative to the auxiliary carriage and are a component of a first sensor unit.

9. The construction machine according to claim 8,
wherein a second sensor unit is arranged on the auxiliary carriage parallel to and at a distance from the first sensor unit; and
wherein the second sensor unit is formed by first and second distance sensors that are set at a defined angle relative to the auxiliary carriage.

10. The construction machine according to claim 8,
wherein at least one of the first and second distance sensors is an ultrasound sensor or a LIDAR sensor; or
wherein the first distance sensor is an ultrasound sensor and the second distance sensor is a LIDAR sensor.

11. The construction machine according to claim 1, further comprising a machine controller or an operating terminal, wherein the at least one sensor is connected with the machine controller and/or the operating terminal.

12. The construction machine according to claim 1, further comprising a control unit;
wherein the at least one actuator comprises an arm selected from the group consisting of a pivoting arm, an extendable arm, and a pivoting and extendible arm; and
wherein the arm is controllable by way of the control unit.

13. The construction machine according to claim 12, wherein a manipulator is arranged on the arm of the at least one actuator.

14. The construction machine according to claim 13, wherein the manipulator is selected from the group consisting of a gripper, a screwing tool, and a drilling flute cleaning tool.

15. The construction machine according to claim 12, wherein the arm is connected with a hydraulically or electrically driven swivel motor or cylinder configured to pivot the arm.

16. The construction machine according to claim 15, wherein the hydraulically or electrically driven swivel motor or cylinder has a self-locking mechanism.

17. The construction machine according to claim 1, wherein at least one of a read device and a write device for contact-free data collection, data storage, or contact-free data collection and data storage is provided on the auxiliary carriage (4).

18. The construction machine according to claim 1, further comprising a control device connected with the second drive and the first drive and comprising a memory module in which at least one movement sequence of the auxiliary carriage and the at least one actuator arranged on the auxiliary carriage is stored in memory.

19. The construction machine according to claim 18, wherein the control device is connected with the at least one sensor of the auxiliary carriage and set up in such a manner that a movement of the auxiliary carriage and/or of the at least one actuator takes place as a function of the sensor signals detected from the at least one sensor.

20. The construction machine according to claim 1, wherein the work device is a drilling implement or a pile-driving implement.

* * * * *